US006938522B1

(12) United States Patent
Stannik

(10) Patent No.: US 6,938,522 B1
(45) Date of Patent: Sep. 6, 2005

(54) CABLE WRENCH

(76) Inventor: Robert Thomas Stannik, 12428 45th Dr. Northeast, Marysville, WA (US) 98271

( * ) Notice: Subject to any disclaimer, the term of this patent is extended or adjusted under 35 U.S.C. 154(b) by 0 days.

(21) Appl. No.: 10/985,099

(22) Filed: Nov. 10, 2004

(51) Int. Cl.[7] ..... B25B 13/00
(52) U.S. Cl. ..... 81/124.2; 81/176.2; 81/119; 350/96.2; 385/56
(58) Field of Search ..... 81/124.2, 176.2, 81/119, 121.1, 176.1, 176.15; 350/96.2; 385/56; 439/304

(56) References Cited

U.S. PATENT DOCUMENTS

| | | | | |
|---|---|---|---|---|
| 798,325 | A | 8/1905 | Daddysman, Jr. | |
| 2,772,590 | A | 12/1956 | Werries | |
| 4,393,583 | A | 7/1983 | Zwald | |
| 4,749,251 | A * | 6/1988 | Moulin | 385/78 |
| 5,031,981 | A * | 7/1991 | Peterson | 385/56 |
| 5,723,818 | A * | 3/1998 | Yeh | 174/74 R |
| 6,153,830 | A * | 11/2000 | Montena | 174/88 C |
| 6,725,747 | B2 | 4/2004 | Erwin | |
| 6,848,920 | B2 * | 2/2005 | Fox | 439/133 |

OTHER PUBLICATIONS

Michael Holland, US Published Patent Application. "F-Type Connector Installation anmd Removal Tool." U.S. Appl. No. 10/290,688, filed Nov. 7, 2002. Published May 13, 2004.
Lucius Neil Jonett, US Published Patent Application. "Little Fingers." U.S. Appl. No. 09/732,038, filed Dec. 8, 2001.

* cited by examiner

*Primary Examiner*—Joseph J. Hail, III
*Assistant Examiner*—Alvin J. Grant
(74) *Attorney, Agent, or Firm*—Apex Juris, pllc; Tracy M. Heims

(57) ABSTRACT

A Cable Wrench that guides, connects and disconnects an F-Connector male end attached to a coaxial cable, to an F-Connector female connection on a TV, VCR, computer or any other device that uses coaxial cable or a cable splitter. This invention prevents the coaxial cable from becoming disengaged, or from slipping out of the cable wrench by using a curved slot that runs the entire axial length of the tool. The wrench provides a large cut away section at the wrench end to allow better visibility while operating the tool and a section adjacent to and behind the wrench portion that is wider in order to allow use of the tool with crimped or large connectors.

20 Claims, 6 Drawing Sheets

CABLE WRENCH

BACKGROUND OF THE INVENTION

1. Field of the Invention

This invention relates to a Cable Wrench and, more particularly, this invention relates to a Cable Wrench that guides, connects and disconnects an F-Connector male end, attached to a coaxial cable, to an F-Connector female connection on a TV, VCR, computer or any other device that uses coaxial cable or a cable splitter. Further, this invention prevents the coaxial cable from becoming disengaged, or from slipping out of the cable wrench; it also provides a low cost, precise, easily manufactured tool. This tool will be extremely valuable to persons skilled in the field of cable installation and it will also be extremely valuable to lay persons who occasionally have to connect or disconnect coaxial cable.

2. Description of Related Arts

The function of this invention is carried out today using a tool that has a wrench socket that includes a socket connection portion adapted to receive a lug member and a straight slot portion that runs axially along the length of the handle for coaxial cable placement. With this tool it is necessary to run or place the coaxial cable into the straight slot to place the socket connection portion over the lug member. The tool is then rotated to tighten or loosen the connection. While using the current tool, and during rotation, it is common for the coaxial cable to eject, or to pop out of the straight slot, at which point the cable tends to wrap around the cable tool and the user's hand and can also cause the cable to break away from the F-Connector. Also, the current tool is not wide enough behind the hex stop, thus preventing the tool from turning freely. In other words, it does not allow or have room for a crimped F-Connector, and therefore the tool is unable to rotate freely around the F-Connector. Also, the current tool is narrow at the leading end of the tool, thereby covering and obscuring the nut and the small copper wire of the coaxial cable, making it difficult for the user to see and to place the wrench end of the tool over the connector ring of the male end of the F-type connector.

Another existing tool in the art is a screw-driver based design equipped with a straight slot down the side and a hex head. This tool slides over a coaxial cable and down to an F-Connector. With simple rotation, like a screwdriver, the connector can be tightened or loosened. This tool is intended to simplify the process of attaching and removing coaxial cables by preventing the wrapping of the cable around the tool and the user's hand. (See U.S. 20020002882, Little Fingers, Lucius Neil Jonett.) Again, however, the problem with this tool is that because it utilizes a straight slot the coaxial cable does not stay in the slot. Consequently, the cable wraps around the user's hand and is not stable, making it difficult to screw the connector ring. Also, the tool does not allow for easy use with a crimped F-Connector, and therefore it is unable to freely rotate around the F-Connector.

Another prior tool is an F-type connector installation and removal tool by Michael Holland, U.S. 20040092165. This is a tool that is operable for connecting a male F-type coaxial cable connector to a female F-type connector. The tool includes a wrench portion and a grasping portion that is affixed to and integral with the wrench portion. The leading end and preferably the trailing end of the grasping portion are slotted. This tool allows accessibility to tight spaces, but again, this is a slotted tool and the slot configuration does not prevent the cable from wrapping around the user's hand.

Also, the current tool does not allow for a crimped F-Connector, and therefore the tool is unable to rotate around the F-Connector freely.

Still another prior tool is one by Zamanazadeh, U.S. Pat. No. 5,992,010 that discloses a coaxial cable connecting tool that includes a hollow elongated housing comprised of two halves hinged together. The halves are closed around a female coaxial cable connector. When the halves are closed a hexagonal hole is formed at one end, and another hole is formed at the opposite end. The hexagonal sleeve on the connector is snugly positioned in the hexagonal hole, and the cable is positioned through the opposite hole. The sleeve is then rotated by turning the housing by hand. The housing is substantially wider than the sleeve on the connector, and includes a hexagonal outer surface, so that it may be easily gripped and turned by hand. In a second embodiment the housing is provided as a built-in component on new connectors. Again, this tool does not provide an extra wide notch at the hex end for wide or crimped cable; it does not provide an extra notch or cut away for visibility; nor does it prevent the cable from wrapping around the tool or the user's hand.

The present invention provides several advantages over the currently existing tools. With respect to the currently existing tools, none of them prevent the cable from wrapping around the tool and/or the user's hand; they do not allow for a wide or crimped F-Connector; and they do not provide an extra wide notch or cut away at the wrench portion to enable better visibility while connecting the male to the female ends.

BRIEF DESCRIPTION OF THE DRAWING

The above and other objects and the attendant advantages of the present invention will become readily apparent by reference to the following detailed description when considered in conjunction with the accompanying drawings, in which.

DETAILED DESCRIPTION OF THE INVENTION

Brief Description of the Invention

As the basis for the present invention, the conventional art involves coaxial cable connector tools that have any or all of the following: a straight slot portion for the coaxial cable; a covered or a narrow hex end that prevents visibility of the cable tool connection to the connector ring; a portion behind the hex stop that prevents the rotation of crimped F-Connectors because the portion behind the hex stop is not wide enough to compensate for the flare of a crimped F-Connector, thereby causing damage to the cable connection and to the F-Connector.

The present invention uses either a curved slot portion, with or without a sleeve cover, or a straight slot portion with a sleeve cover. The present invention also uses an extra wide notch or cut away at the wrench end to enable visibility. Finally, the present invention utilizes a wider section behind the hex stop, that can run the entire length of the tool, to allow for wide or crimped connectors. Because of the previously mentioned problems in the art the inventor has worked to create the features of the present invention to address these issues and problems. The present invention prevents the coaxial cable from wrapping around the tool and/or the user's hand; the present invention is wider behind the hex stop so as to enable the tool to turn freely around the F-Connector and to allow for wide or crimped F-Connectors thus avoiding damage to the cable connection; the present invention has an extra wide notch or cut away at the wrench end to enable better visibility while connecting the male to the female ends.

The features of the invention believed to be novel are set forth with particularity in the appended claims. However, the invention itself, both as to organization and method of operation, together with further objects and advantages thereof may be best understood by reference to the following description taken in conjunction with the accompanying drawings.

EMBODIMENT OF THE INVENTION

The present invention provides a tool for connecting or disconnecting coaxial cable, or any other cable that utilizes a hex nut; the tool prevents the coaxial cable from wrapping around the tool and/or the user's hand; the tool is usable with a crimped F-connector; the tool provides better guidance for the cable, it provides better visibility during operation and avoids cross threading of the F-Connector to the female connectors. An examples of this invention are explained with reference to FIG. 1 through FIG. 6.

Figure 1:
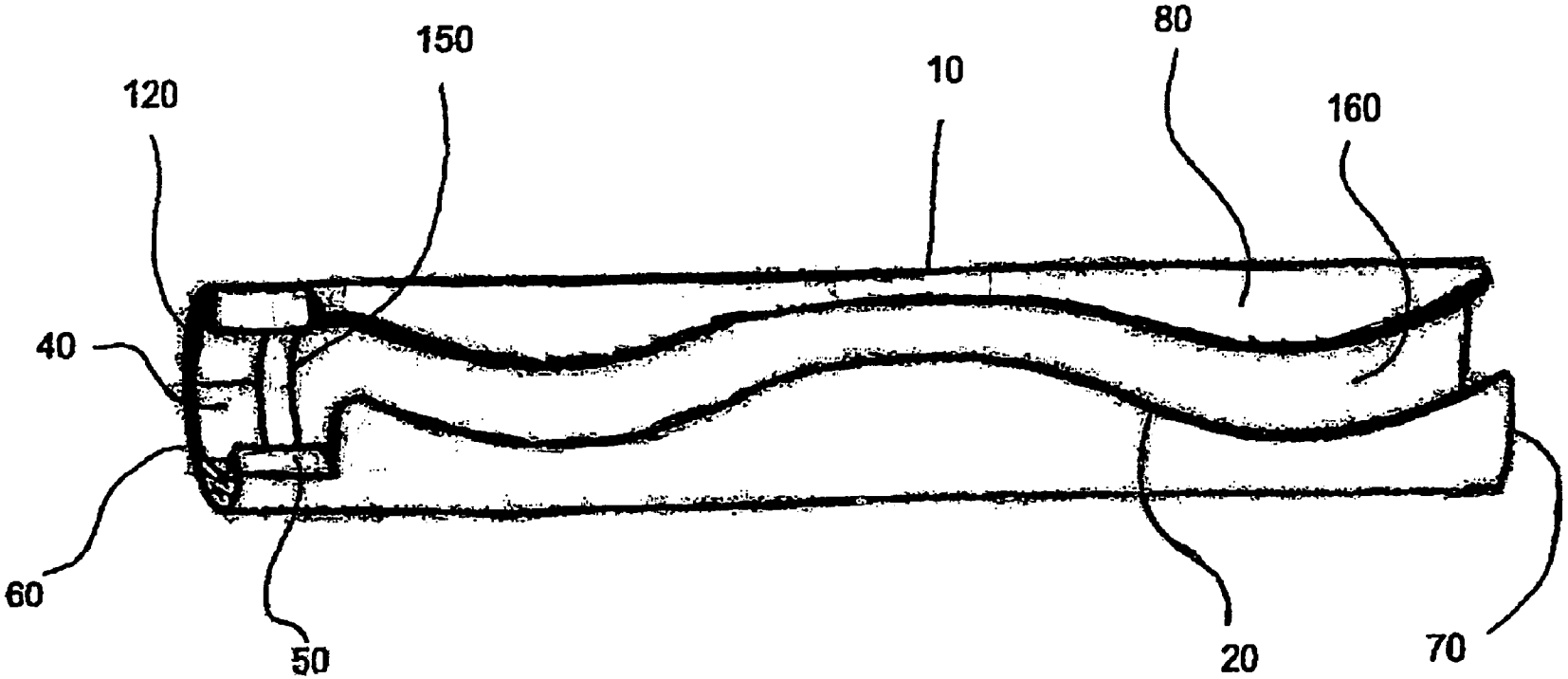
FIG. 1 is a perspective view of the present invention with a curved slot and without a sleeve.

FIG. 1 is a perspective view of a cable tool 10 shown without a sleeve. The cable tool 10 is of integral construction and comprises a wrench portion 40 at a leading end 60 where the cable tool is a hollow, rigid, substantially cylindrical member and the wrench portion 40 has an inner chamber 160 that has a shaped portion 120 dimensioned to matingly engage a shaped outer surface of a connector 100. Further, the cable tool 10 has a curved slot 20 or an S-curve slot that runs coextensive with the axial length of the entire body of the cable tool 10, from a leading end 60 to a trailing end 70.

Figure 2:
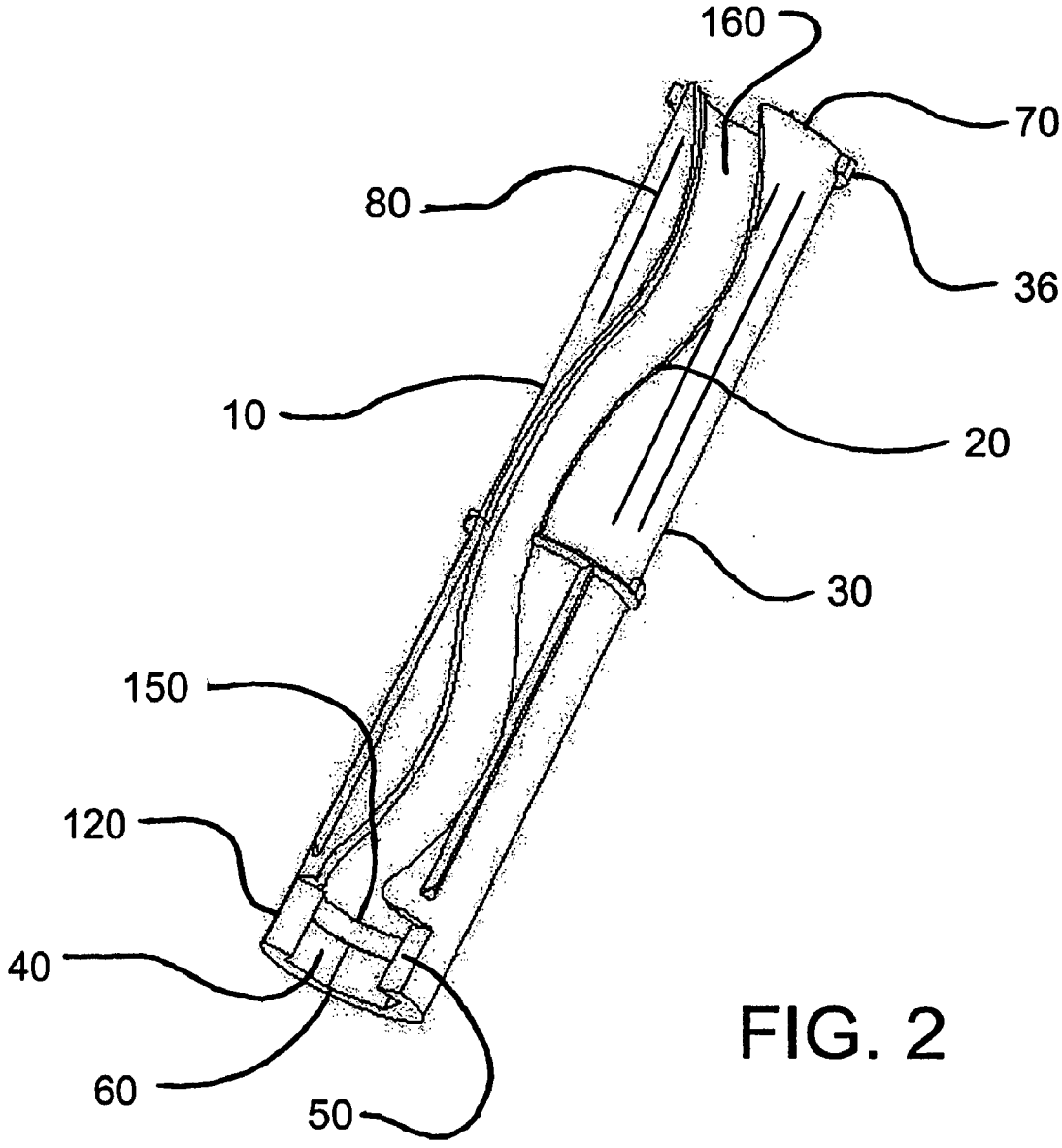
FIG. 2 is a perspective, angled view of the present invention with a curved slot and with a sleeve.

FIG. 2 is a perspective view of a cable tool 10 shown with the curved slot 20 and a sleeve 30. The cable tool 10 is of integral construction and comprises a wrench portion 40 at a leading end 60 where the cable tool 10 is a hollow, rigid, substantially cylindrical member and the wrench portion 40 has an inner chamber 160 that has a shaped portion 120 dimensioned to matingly engage a shaped outer surface of a connector 100. Further, the cable tool 10 has a curved slot 20 that runs coextensive with the axial length of the entire body of the cable tool 10, from a leading end 60 to a trailing end 70. Still further, the cable tool 10 has a sleeve 30 that fits matingly and encapsulatingly over the main body of the cable tool 10 and that runs coextensive with the axial length of the body of the cable tool 10. Also, the sleeve has a curved slot 32 that runs the length of the sleeve 30 and where the curved slot 32 is wide enough to allow a coaxial cable to pass through the slot.

Figure 3:
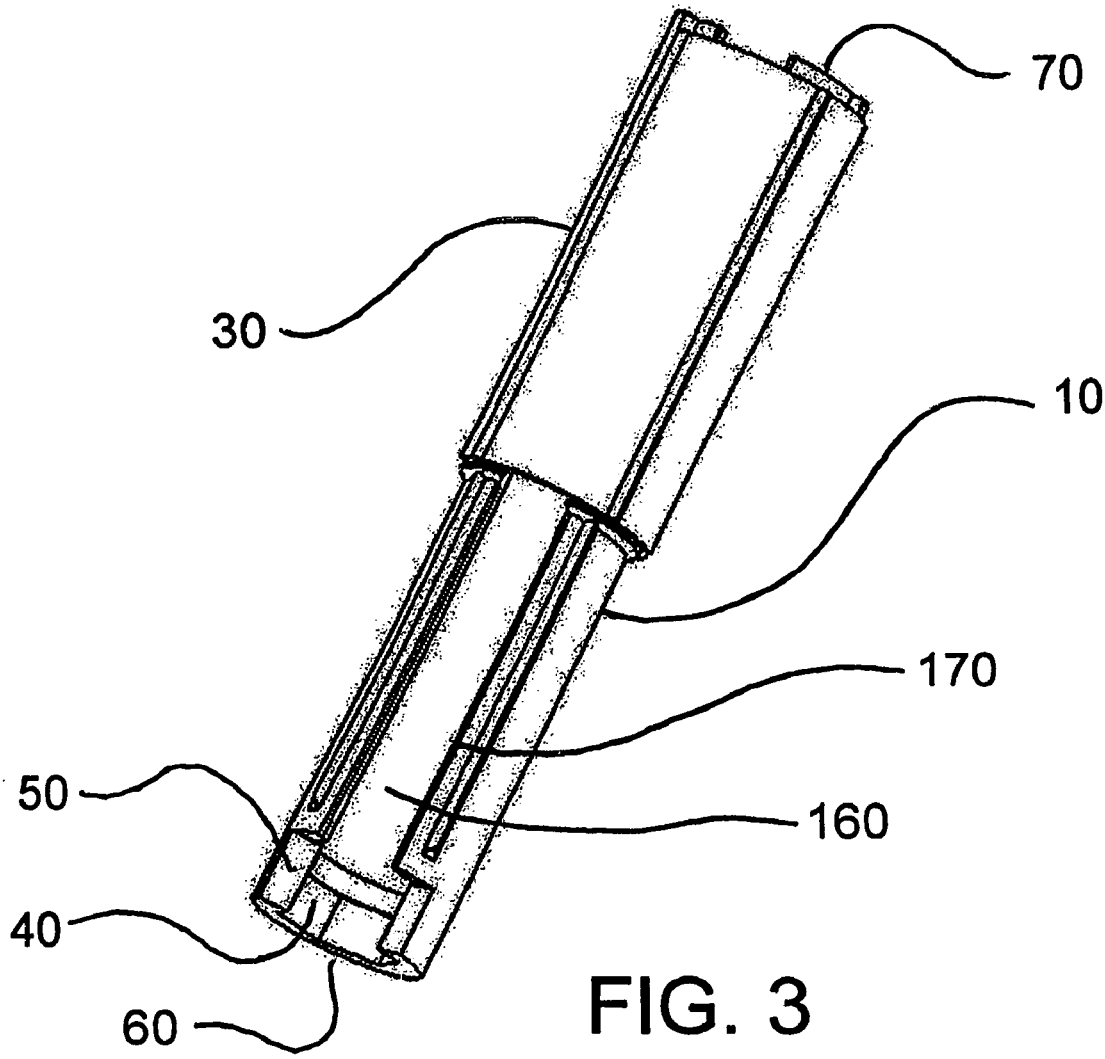
FIG. 3 is a perspective, angled view of the present invention with a straight slot and with a sleeve.

FIG. 3 is a perspective view of the cable tool 10 shown with a straight slot 170 and with a sleeve 30.

Figure 4:
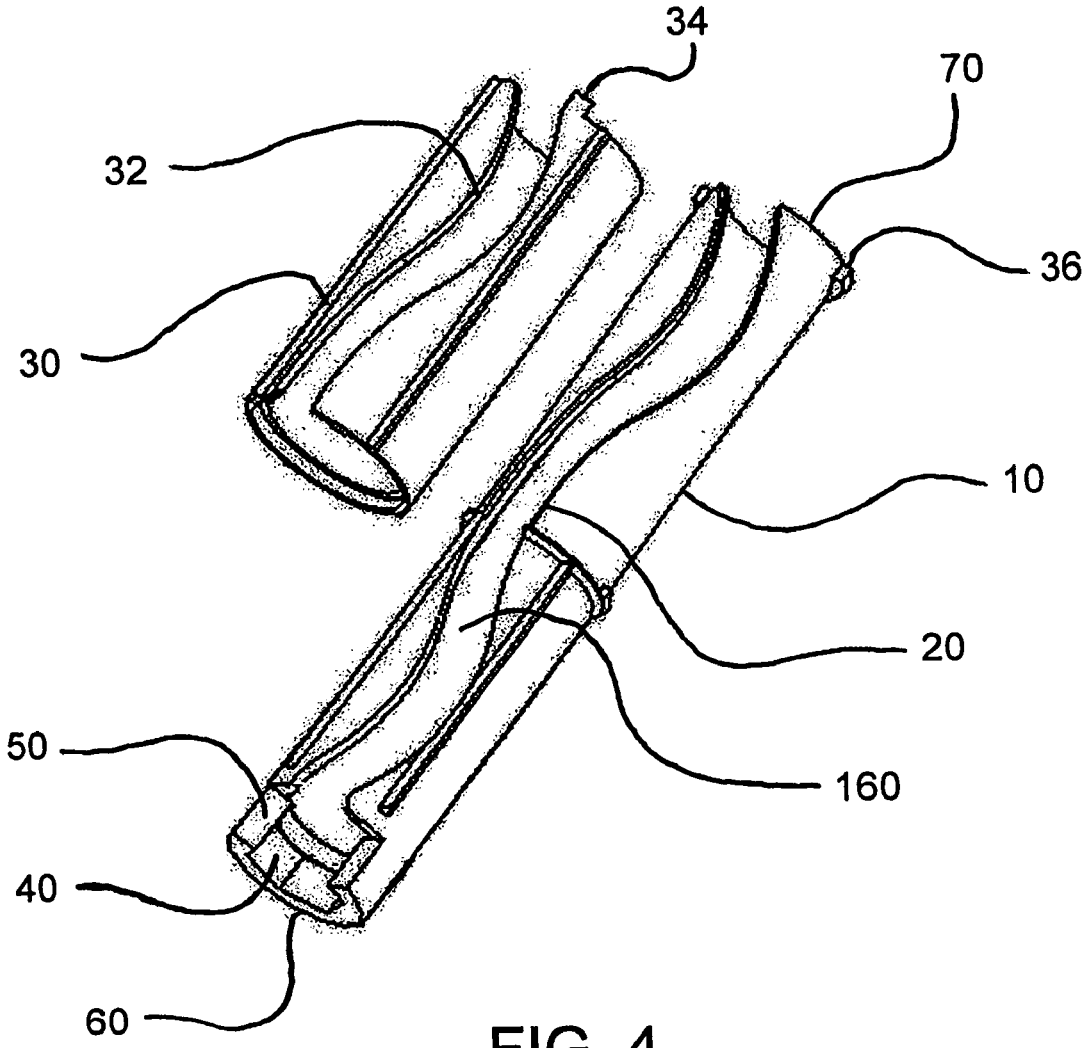
FIG. 4 is a perspective, angled and expanded view of the present invention with a curved slot and with the sleeve removed from the main body.
Figure 5:
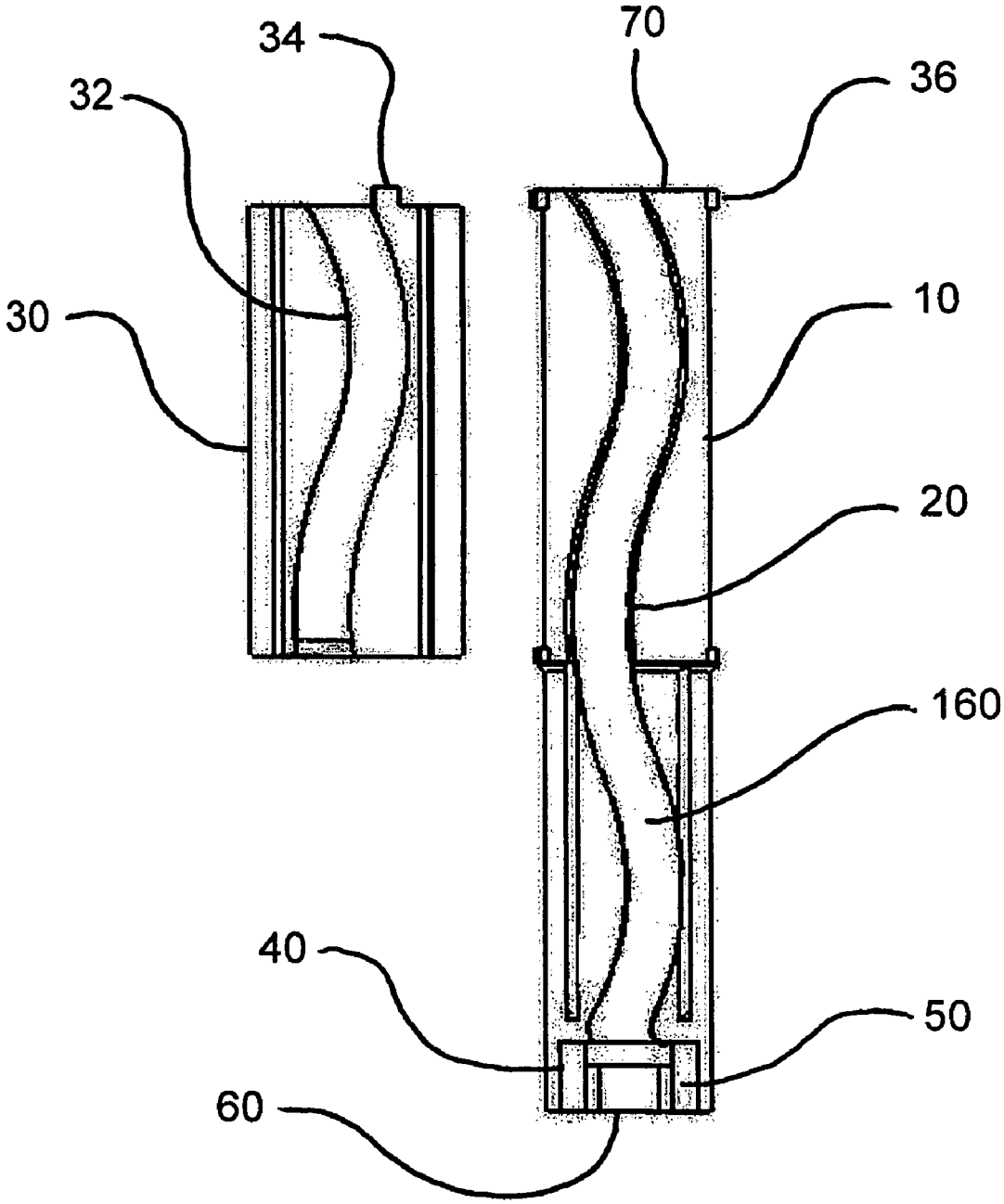
FIG. 5 is a perspective, expanded view of the present invention with a curved slot and sleeve removed from the main body.

FIG. 4 is a perspective view of the cable tool 10 and is more particularly an expanded view of the cable tool and the sleeve 30. FIG. 4 shows an embodiment where the sleeve 30 could have one or more tang 34 that are used with one of more tang stops 36 that are formed on the cable tool 10. The tangs and tang stops are used to prevent the sleeve from rotating completely around the tool. When the sleeve is rotated clockwise the tangs strike the tang stops, thereby preventing the sleeve from further rotation and effectively locking the coaxial cable within the chamber. When the sleeve is rotated in the counterclockwise direction the tangs strike the tang stops on the opposite side of the tool, again preventing the sleeve from completely rotating around the tool. When turned in this direction they effectively stop the tool in an open position, enabling insertion and removal of the coaxial cable.

In lieu of the tangs and tang stops the cable tool 10 could have one or more ridges that run axially along the length of the body of the sleeve 30 and that matingly engage in at least one slot that run axially along the length of the body of the cable tool 10 that lock the sleeve 30 in either an open or closed position thereby acting as stops to prevent the sleeve 30 from rotating.

Figure 6:
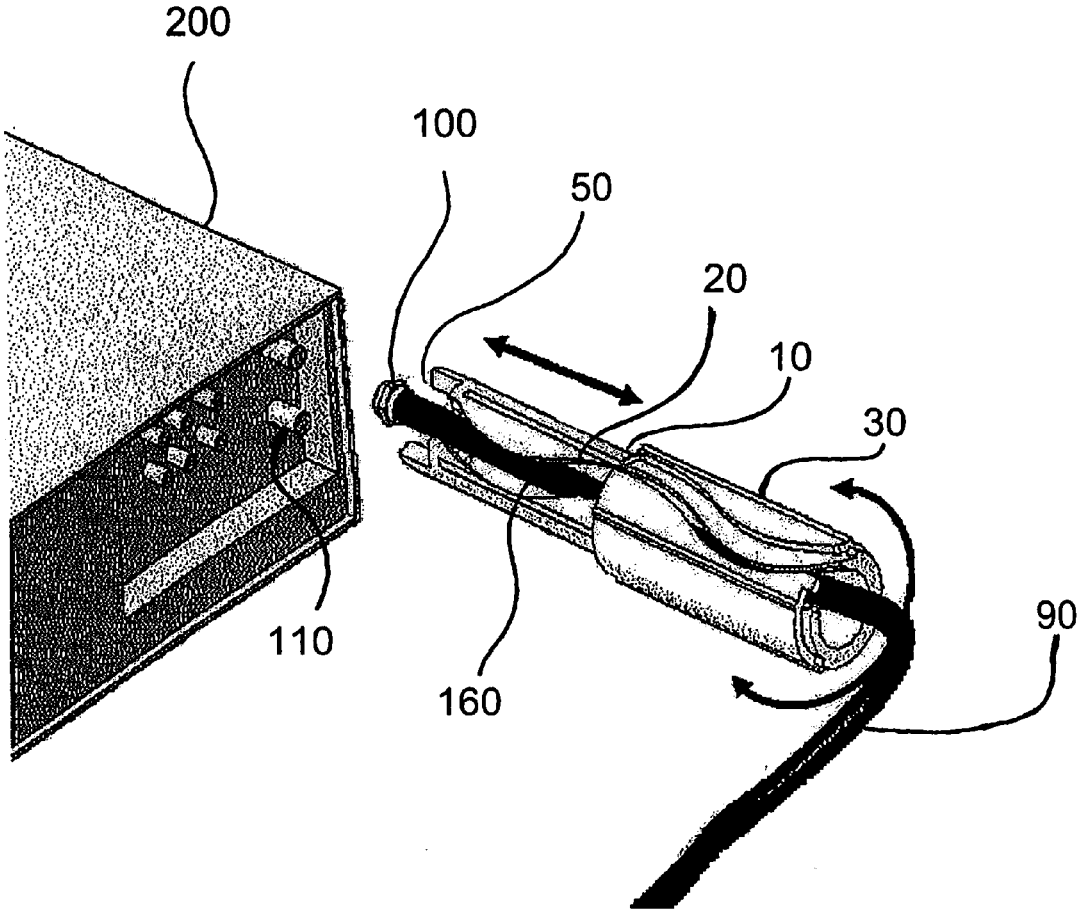
FIG. 6 is a perspective view of the present invention shown as it would be used in a typical cable installation.

The operation of the cable tool 10 can be understood by reference to FIG. 1 and FIG. 6. To operate the cable tool 10 a coaxial cable 90 is fed through the curved slot 20 along the axial length of the entire body of the cable tool 10 and into the inner chamber 160. After the coaxial cable 90 is resting within the inner chamber 160 of the cable tool 10 the coaxial cable 90 is prevented from falling out of the inner chamber 160 due to the curved slot 20. The cable is secured within the inner chamber 160 and this prevents the coaxial cable 90 from wrapping around the cable tool 10 and/or the user's hand when the tool is operated. Once the coaxial cable 90 is positioned within the inner chamber 160 of the cable tool 10, the cable tool 10 is advanced along the length of the cable until the wrench portion 40 engages the male F-type connector 100. When the cable tool 10 is thus disposed with respect to the male F-type connector 100, the shaped inner surface 120 of the cable tool 10 engages the shaped outer surface of the connector ring 100. The male F-type connector is then matingly engaged with a female F-type connector. The grasping portion 80 of the cable tool 10 is then gripped by fingers and the cable ol 10 is rotated clockwise to connect the connectors or counterclockwise to disconnect the connectors. After the connectors are fully connected or disconnected the coaxial cable 90 is removed from the inner chamber 160 by pulling the coaxial cable 90 through and along the curved slot 20 that runs along the axial length of the entire body of the cable tool 10, thereby freeing the coaxial cable 90.

An alternative embodiment is best understood by reference to FIG. 3. To operate the tool of this embodiment a coaxial cable 90 is fed through a straight slot 170 along the axial length of the entire body of the cable tool 10, through a straight slot along the length of the sleeve, and into the inner chamber 160. After the coaxial cable 90 is resting within the inner chamber 160 of the cable tool 10 the sleeve 30 is rotated either clockwise or counterclockwise, moving the slotted portion of the sleeve and thus covering the coaxial cable 90, creating a closed, secure chamber where the coaxial cable 90 rests within.

A variation of this embodiment utilizes a sleeve 30 where the sleeve 30 has one or more tang 34 and one or more tang stops 36. The tangs and tang stops are used to prevent the sleeve from rotating completely around the tool. When the sleeve is rotated clockwise the tangs 34 strike the tang stops 36, thereby effectively stopping further sleeve rotation and locking the coaxial cable 90 within the chamber, preventing the cable 90 from escaping the inner chamber 160. When the sleeve is rotated in the counterclockwise direction the tangs strike the tang stops on the opposite side of the tool, again preventing the sleeve from completely rotating around the tool. When turned in this direction they effectively stop the sleeve rotation in an open position, enabling insertion and removal of the coaxial cable.

Another variation of this embodiment utilizes a cable tool 10 that could have one or more ridges that run axially along the length of the body of the sleeve 30 and that matingly engage slots that run axially along the length of the body of the cable tool 10 that secure or lock the sleeve 30 in either an open or closed position thereby acting as stops to prevent the sleeve 30 from rotating.

Another alternative embodiment of the present invention is best understood by reference to FIG. 2. To operate the tool of this embodiment a coaxial cable 90 is fed into the curved slot 20 along the axial length of the entire body of the cable tool 10 and into the inner chamber 160. After the coaxial cable 90 is resting within the inner chamber 160 of the cable tool 10 a sleeve 30 is rotated clockwise or counterclockwise, thus covering the coaxial cable 90 and creating a closed chamber where the coaxial cable 90 rests within. By rotating the sleeve 30 and creating the closed chamber the coaxial cable 90 is prevented from falling out of the inner chamber 160. Alternatively, the user could choose to not rotate the sleeve 30. If the user did not rotate the sleeve 30 the coaxial cable 90 is still prevented from falling out of the inner chamber 160 because of the curved slot 20. Both configurations prevent the coaxial cable 90 from wrapping around the cable tool 10 and/or the user's hand. Once the coaxial cable 90 is positioned within the inner chamber 160 of the cable tool 10 and the sleeve 30 is either rotated to create the closed chamber or left open the cable tool 10 is advanced along the length of the cable until the wrench portion 40 engages the male F-type connector 100. When the cable tool 10 is thus disposed with respect to the male F-type connector 100, the shaped inner surface 120 of the cable tool 10 engages the shaped outer surface of the connector ring 150. The male F-type connector is then matingly engaged with a female F-type connector. The grasping portion 80 is then gripped by fingers and the cable tool 10 is rotated clockwise to connect the connectors or counterclockwise to disconnect the connectors. After the connectors are fully connected or disconnected the coaxial cable 90 is removed from the inner chamber 160 by rotating the sleeve 30 in the clockwise or counterclockwise direction and by pulling the coaxial cable 90 from the inner chamber 160, or alternatively, if the user has not rotated the sleeve 30, by simply pulling the cable out of the inner chamber 160 through the curved slot 20.

This embodiment could utilize a sleeve that could have one or more ridges that run axially along the length of the body of the sleeve 30 and that matingly engage slots that run axially along the length of the body of the cable tool 10 that lock the sleeve in either an open or closed position thereby acting as stops to prevent the sleeve 30 from rotating.

This embodiment could also utilize the tangs and tang stops as described above to prevent the sleeve from continual rotation around the cable tool body.

Also, the outer surface or grasping portion 80 of the cable tool 10 of any of the embodiments may be knurled or textured, it may be ribbed, have ridges, or any other raised portion, or it may have any other alteration or modification of the exterior surface that is designed to assist the user and to prevent finger slippage when torque is applied to the tool 10.

Another variation of the any of the previously described embodiments of the cable tool 10 is an extra wide notch or cut away 50 at the leading end 60 that allows the operator to easily and more fully see the connection process. This embodiment of cable tool 10 still allows the user an adequate shaped portion 120 that sufficiently grabs the connector ring while simultaneously allowing the user to view the connection to facilitate ease of operation.

A final variation of the cable tool 10 further provides a wider portion inside the tool, behind the hex stop, directly adjacent to and behind the wrench portion. This wider portion allows a crimped or a large cable end to fit without catching on the wrench portion during tool operation and enables the tool to turn freely about the F-Connector 100 thereby avoiding damage to the cable connection or to the F-Connector. This extra wide portion may be only directly behind the hex stop or it may run the entire length of the tool. Many F-Connectors have a flared portion between the end of the F-Connector adjacent to the coaxial cable and the coaxial cable and, due to this flare, it is often difficult to rotate the F-Connector. The present embodiment eliminates this problem.

It is readily apparent that the above-described invention has the advantages of wide commercial utility. It may be understood that the specific form of the invention hereinabove described is intended to be representative only, and certain modifications within the scope of those teachings will be apparent to those skilled in the art without departing from the spirit and scope of the invention.

While the foregoing invention has been shown and described with reference to preferred embodiments, it will be understood by those possessing skill in the art that various changes and modifications may be made without departing from the spirit and scope of the invention. Accordingly, reference should be made to the following claims in determining the full scope of the invention.

What I claim is:

1. A cable tool comprising:

a substantially hollow, cylindrical body with a leading end and a trailing end;

a wrench portion at said leading end;

an inner chamber at said wrench portion that has a shaped portion dimensioned to matingly engage a shaped periphery of a connector and;

a curved slot that runs coextensive with the axial length of the entire body of said cable tool from said leading end to said trailing end.

2. The cable tool as in claim 1, in which the wrench portion has a cut away section.

3. The cable tool as in claim 1, in which the wrench portion has a stop behind said shaped portion.

4. The cable tool as in claim 1, further comprising a wide portion directly adjacent to and behind said wrench portion that allows a crimped or a large cable end to fit without catching on said wrench portion.

5. The cable tool as in claim 1, in which the wrench portion is for matingly engaging with an F-type Connector.

6. The cable tool as in claim 1, in which a sleeve encapsulates said cylindrical body and said sleeve is rotatable around said cylindrical body and said sleeve has a curved slot that matches said curved slot in said cylindrical body and that is wide enough to allow for a cable to pass through.

7. The cable tool as in claim 1, in which said sleeve has at least one ridge that runs coextensive with the axial length of the sleeve and said ridge matingly fits into at least one slot that runs the axial length of said cylindrical body.

8. The cable tool as in claim 1, in which said sleeve has at least one tang and said cylindrical body has at least one tang stop.

9. The cable tool as in claim 1 in which the tool is made of metal.

10. The cable tool as in claim 1 in which the tool is made of any hardened material.

11. The cable tool as in claim 1 in which said cylindrical body has an outer surface that is knurled, ribbed or ridged.

12. A cable tool comprising:

a substantially hollow, cylindrical body with a leading end and a trailing end;

a wrench portion at said leading end;

an inner chamber at said wrench portion that has a shaped portion dimensioned to matingly engage a shaped periphery of a connector;

a straight slot that runs coextensive with the axial length of the entire body of said cable tool from said leading end to said trailing end and;

a sleeve that encapsulates said cylindrical body and said sleeve is rotatable around said cylindrical body and said sleeve has a straight slot that is wide enough to allow for a cable to pass through.

13. The cable tool as in claim 12, in which said wrench portion has a cut away section.

14. The cable tool as in claim 12, in which the wrench portion has a stop behind said shaped portion.

15. The cable tool as in claim 12, further comprising a wide portion directly adjacent to and behind said wrench portion that allows a crimped or a large cable end to fit without catching on said wrench portion.

16. The cable tool as in claim 12 in which said sleeve has at least one ridge that runs coextensive with the axial length of the sleeve and said ridge matingly fits into at least one slot that runs the axial length of said cylindrical body.

17. The cable tool as in claim 12, in which said sleeve has at least one tang and said cylindrical body has at least one tang stop.

18. The cable tool as in claim 12 in which the tool is made of metal.

19. The cable tool as in claim 12 in which the tool is made of any hardened material.

20. The cable tool as in claim 12 in which said cylindrical body has an outer surface that is knurled, ribbed or ridged.

* * * * *